US011845604B2

(12) United States Patent
Vasiliades et al.

(10) Patent No.: US 11,845,604 B2
(45) Date of Patent: Dec. 19, 2023

(54) TEXTURE MATERIAL DISPENSING SYSTEM INCLUDING A FOLDABLE HANDLE AND TRIGGER

(71) Applicant: DAP Products Inc., Baltimore, MD (US)

(72) Inventors: Louis Vasiliades, Baltimore, MD (US); James Kenney, Baltimore, MD (US); Kenneth Rueschhoff, Fenton, MO (US); Nicholas Lange, Fenton, MO (US)

(73) Assignee: DAP PRODUCTS INC., Baltimore, MD (US)

( * ) Notice: Subject to any disclaimer, the term of this patent is extended or adjusted under 35 U.S.C. 154(b) by 0 days.

(21) Appl. No.: 17/806,392

(22) Filed: Jun. 10, 2022

(65) Prior Publication Data

US 2022/0396413 A1 Dec. 15, 2022

Related U.S. Application Data

(60) Provisional application No. 63/209,144, filed on Jun. 10, 2021.

(51) Int. Cl.
*B65D 83/20* (2006.01)

(52) U.S. Cl.
CPC ..... *B65D 83/206* (2013.01)

(58) Field of Classification Search
CPC ..... B65D 83/206; B65D 83/40; B65D 83/56; B05B 15/63
See application file for complete search history.

(56) References Cited

U.S. PATENT DOCUMENTS

| | | | | |
|---|---|---|---|---|
| 4,523,705 | A * | 6/1985 | Belanger | B05C 17/0053 74/141.5 |
| 4,795,064 | A * | 1/1989 | Sheu | B05C 17/0055 222/113 |
| 6,000,626 | A * | 12/1999 | Futo | B05B 7/2464 239/526 |
| 6,029,862 | A * | 2/2000 | Jones | B65D 83/202 222/402.15 |
| 6,244,469 | B1 * | 6/2001 | Knickerbocker | B05B 11/1011 222/153.14 |
| 9,435,120 | B2 | 9/2016 | Hanson et al. | |
| 9,776,785 | B2 | 10/2017 | Hanson et al. | |
| 2014/0272140 | A1 * | 9/2014 | Hanson | C09K 3/30 427/256 |
| 2016/0166761 | A1 * | 6/2016 | Piehl | A61B 17/3498 604/207 |
| 2016/0175878 | A1 * | 6/2016 | Belanger | B05B 11/048 222/325 |
| 2016/0279652 | A1 * | 9/2016 | States, III | A01M 1/2033 |
| 2022/0396413 | A1 * | 12/2022 | Vasiliades | B05B 15/63 |

* cited by examiner

*Primary Examiner* — Bob Zadeh
(74) *Attorney, Agent, or Firm* — Armstrong Teasdale LLP

(57) ABSTRACT

Described herein is a texture material dispensing system that includes a foldable handle and trigger. The texture material dispensing system may be used for dispensing a texture material onto a target surface, such as a ceiling.

20 Claims, 25 Drawing Sheets

TEXTURE MATERIAL DISPENSING SYSTEM INCLUDING A FOLDABLE HANDLE AND TRIGGER

CROSS-REFERENCE TO RELATED APPLICATIONS

This application claims priority to U.S. Provisional Application Ser. No. 63/209,144, filed on Jun. 10, 2021, the content of which is hereby incorporated by reference in its entirety.

FIELD OF DISCLOSURE

The present disclosure is directed to a texture material dispensing system that includes a foldable handle and trigger. The texture material dispensing system may be used for dispensing a texture material onto a target surface, such as a ceiling.

BACKGROUND

Liquid spray dispensers can be utilized in a variety of applications. For instance, spray dispensers may utilize aerosol to dispense coatings such as texture material, paint, or household cleaners. Handheld liquid spray dispensers generally utilize aerosol as a propellant to propel liquid through a nozzle, in response to actuation of a valve that results in pressurized liquid being propelled out of an attached spray can. For instance, a trigger or other mechanism may be used to actuate the valve, with liquid in the can being propelled through a nozzle and out of an orifice of the spray dispenser onto a surface.

While useful for a variety of applications, known spray dispensers may suffer from a lack of an ergonomic use for a variety of orientations, such as spraying onto a ceiling. Such known spray dispensers are unsuitable for long term use.

In addition, known spray dispensers may be designed for spraying onto a wall only and not for effective spraying onto a target surface directly above a user. In particular, known spray dispensers may be unsuitable for spraying different surfaces, such as a ceiling, without compromising the orientation of a texture material container connected to the dispenser. Such known spray dispensers are incapable of such spraying and attempts at such spraying may result in harm to the fluidics of the known spray dispensers, particularly for large differences in the orientation of a texture material container. In some examples, when known sprayers are used to spray a target surface, such as a ceiling directly above a user, the texture material container connected to the sprayer is not effectively actuated by the sprayer's trigger because of the angle the sprayer must be held at to access the target surface directly above. This leads to failure in actuating the valve of the texture material container properly which compromises the sprayer's effectiveness spraying onto ceilings or any target surface directly above the user.

These and other matters have presented challenges to the manufacture and implementation of liquid spray dispensers for a variety of applications. Further, these challenges are particularly relevant to texture material dispensers, which contain and dispense viscous and hardenable compositions. For at least these reasons, there is a need in the industry for a texture material dispensing system with a foldable handle and trigger for spraying target surfaces directly above the texture material dispensing system.

Described herein is a texture material dispensing system with a readily foldable handle and trigger. The texture material dispensing system includes a foldable handle and trigger that fold down to create an applicator for spraying a desired amount of texture material on ceilings ergonomically.

BRIEF DESCRIPTION OF THE DISCLOSURE

In one embodiment of the present disclosure, provided herein is a texture material dispensing system including a container assembly, an actuator assembly, and an outlet assembly. The container assembly includes a container and a valve assembly. The actuator assembly includes an actuator housing, a trigger, and a handle. The actuator housing includes an actuator that is slidably supported relative to the actuator housing by at least one rail portion. The trigger is pivotably attached to the actuator. The handle is pivotably attached to a portion of the actuator housing. The outlet assembly includes an outlet opening. Depression of the trigger causes pivoting movement of the trigger relative to the actuator. Pivoting movement of the trigger relative to the actuator causes linear movement of the actuator relative to the actuator housing. The linear movement of the actuator engages the valve assembly to alter the valve assembly from a closed configuration to an open configuration.

In another embodiment of the present disclosure, provided herein is a method of using a texture material dispensing system including a container assembly, an actuator assembly, and an outlet assembly. The container assembly includes a container and a valve assembly. The actuator assembly includes an actuator housing, a trigger, and a handle. The actuator housing includes an actuator that is slidably supported relative to the actuator housing by at least one rail portion. The trigger is pivotably attached to the actuator. The handle is pivotably attached to a portion of the actuator housing. The outlet assembly includes an outlet opening. Depression of the trigger causes pivoting movement of the trigger relative to the actuator. Pivoting movement of the trigger relative to the actuator causes linear movement of the actuator relative to the actuator housing. The linear movement of the actuator engages the valve assembly to alter the valve assembly from a closed configuration to an open configuration. The method includes using the texture material dispensing system for dispensing a texture material onto a target surface.

In another embodiment of the present disclosure, provided herein is a texture material dispensing system including a container assembly, an actuator assembly, and an outlet assembly. The container assembly includes a container and a valve assembly. The actuator assembly includes an actuator housing, a trigger, and a handle. The actuator housing includes a pivoting actuator. The trigger is pivotably attached to the pivoting actuator. The handle is pivotably attached to a portion of the actuator housing. The outlet assembly includes an outlet opening. Depression of the trigger causes pivoting movement of the trigger relative to the actuator. Pivoting movement of the trigger relative to the pivoting actuator causes pivoting movement of the pivoting actuator relative to the actuator housing. The pivoting movement of the pivoting actuator engages the valve assembly to alter the valve assembly from a closed configuration to an open configuration.

In yet another embodiment of the present disclosure, provided herein is a method of using a texture material dispensing system including a container assembly, an actuator assembly, and an outlet assembly. The container assembly includes a container and a valve assembly. The actuator assembly includes an actuator housing, a trigger, and a handle. The actuator housing includes a pivoting actuator. The trigger is pivotably attached to the pivoting actuator. The handle is pivotably attached to a portion of the actuator housing. The outlet assembly includes an outlet opening. Depression of the trigger causes pivoting movement of the trigger relative to the actuator. Pivoting movement of the trigger relative to the pivoting actuator causes pivoting movement of the pivoting actuator relative to the actuator housing. The pivoting movement of the pivoting actuator engages the valve assembly to alter the valve assembly from a closed configuration to an open configuration. The method includes using the texture material dispensing system for dispensing a texture material onto a target surface.

BRIEF DESCRIPTION OF THE DRAWINGS

The following figures are examples of texture material dispensing systems in accordance with the present disclosure and are not to be construed as limiting.

Various example embodiments may be more completely understood in consideration of the following detailed description and in connection with the accompanying drawings, in which.

DETAILED DESCRIPTION

Figure 1A:
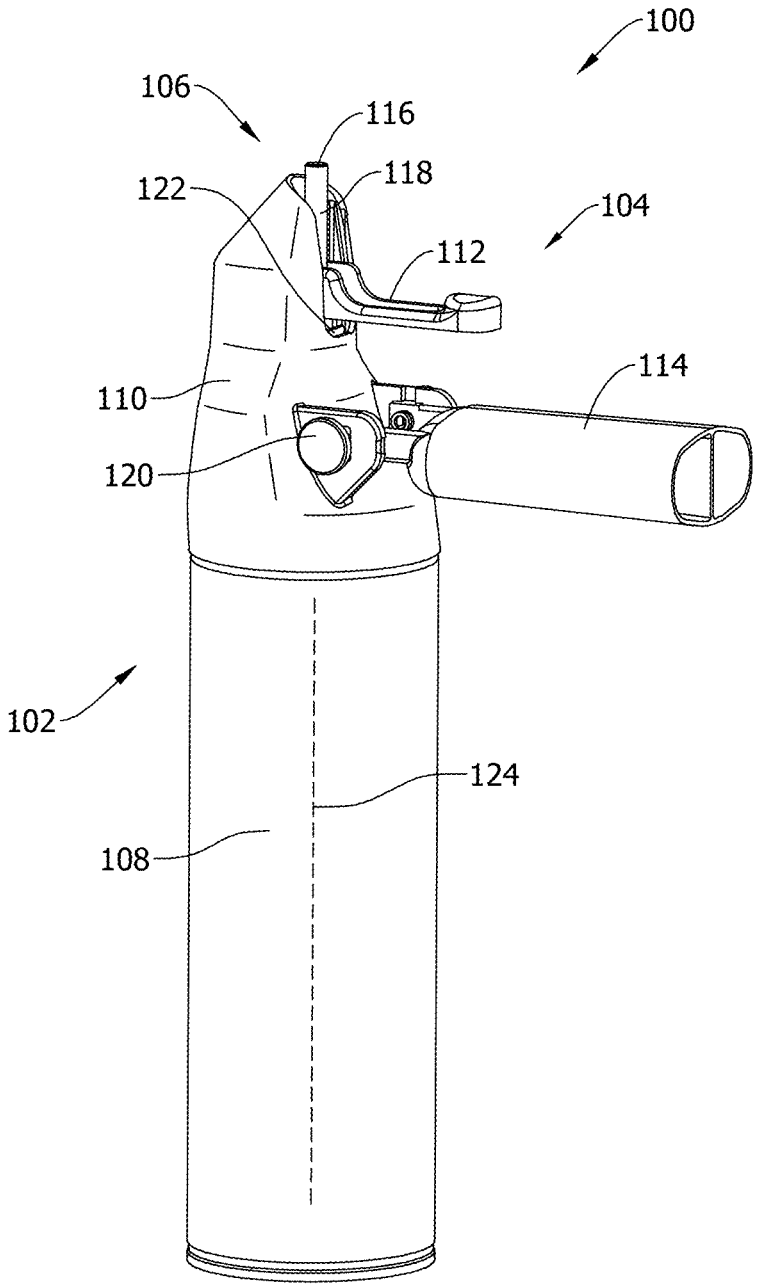
FIG. 1A shows a full view of a of a texture material dispensing system in accordance with the present disclosure in a use position.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims.

Described herein is a texture material dispensing system. The texture material dispensing system may be used for dispensing a texture material onto a target surface. The texture material dispensing system includes an improved actuator, for example on a can of aerosol spray texture, in which the handle and trigger fold down to create an ergonomic applicator for spraying onto ceiling surfaces.

Particularly described herein is a texture material dispensing system including a container assembly, an actuator assembly, and an outlet assembly. The container assembly includes a container and a valve assembly. The actuator assembly includes an actuator housing, a trigger, and a handle. The actuator housing includes an actuator that is slidably supported relative to the actuator housing by at least one rail portion. The trigger is pivotably attached to the actuator. The handle is pivotably attached to a portion of the actuator housing. The outlet assembly includes an outlet opening. Depression of the trigger causes pivoting movement of the trigger relative to the actuator. Pivoting movement of the trigger relative to the actuator causes linear movement of the actuator relative to the actuator housing. The linear movement of the actuator engages the valve assembly to alter the valve assembly from a closed configuration to an open configuration.

Also particularly described herein is a texture material dispensing system including a container assembly, an actuator assembly, and an outlet assembly. The container assembly includes a container and a valve assembly. The actuator assembly includes an actuator housing, a trigger, and a handle. The actuator housing includes a pivoting actuator. The trigger is pivotably attached to the pivoting actuator. The handle is pivotably attached to a portion of the actuator housing. The outlet assembly includes an outlet opening. Depression of the trigger causes pivoting movement of the trigger relative to the actuator. Pivoting movement of the trigger relative to the pivoting actuator causes pivoting movement of the pivoting actuator relative to the actuator housing. The pivoting movement of the pivoting actuator engages the valve assembly to alter the valve assembly from a closed configuration to an open configuration.

Also particularly described herein is a method of using the texture material dispensing system in accordance with the present disclosure. The method includes dispensing a texture onto a target surface. The target surface is preferably a ceiling.

In many embodiments, the texture material dispensing system is configured for dispensing an aerosol including a texture material. In some embodiments, the texture material dispensing system is configured for dispensing a texture material onto a target surface.

In many embodiments, the texture material dispensing system is configured to dispense a texture material when a user holds the handle and depresses the trigger member. In some embodiments, the texture material dispensing system is configured to dispense a texture material when a user simultaneously holds the handle and depresses the trigger member with a single hand. In some embodiments, the texture material dispensing system is configured to dispense a texture material when a user holds the handle and depresses the trigger member with different hands.

In general, a foldable trigger controls actuation of the dispenser. In some embodiments, depression of the foldable trigger causes the foldable trigger to engage the valve assembly to alter the valve assembly from a non-use configuration to a use configuration. When the dispenser is in a use configuration, texture material is able to flow through the dispenser. In some embodiments, the foldable trigger comprises a spring to assist the foldable trigger in returning to a non-use position after depression of the foldable trigger. In some embodiments, the foldable trigger does not comprise a spring.

The foldable trigger and handle pivoting allow a user to use the dispenser for a variety of purposes while ergonomically spraying onto a surface, such as a ceiling, as required by an application. For example, this allows a user to easily spray a texture material onto a surface directly above a user.

The foldable handle provides a number of benefits. Non-limiting examples of these benefits include providing a familiar gripping surface and an orthogonal grip when oriented in a use position and providing benefits to shipping and storage logistics when oriented in a non-use position.

In some embodiments, the trigger is foldable between a non-use position that is aligned substantially parallel to the container assembly axis and a use position that is aligned substantially non-parallel to the container assembly axis. In some embodiments, the handle is foldable between a non-use position that is aligned substantially parallel to a container assembly axis and a use position that is aligned substantially non-parallel to a container assembly axis.

As used herein, the non-use position may comprise a stowed position. When the foldable handle is in a stowed position, the foldable trigger rests in a position that is aligned substantially parallel to the container assembly axis, such as a vertical position. This position provides for protection from inadvertent actuation without the need of a dedicated trigger lock mechanism. It also provides for a compact envelope for shipping, sales displays, and storage by an end user. The handle may also serve as a protector (e.g. cover) to prevent accidental actuation of the trigger. In some embodiments, the handle prevents accidental actuation of the trigger when it is folded in the non-use position that is aligned substantially parallel to a container assembly axis.

In some embodiments, the non-use position comprises a trigger lock-out mechanism in the stowed position. As used herein, a trigger lock-out mechanism is a feature on the trigger that rests on top of, or nests into, the housing or trigger in order to prevent the trigger from actuating the valve. In some embodiments, the trigger lock-out mechanism comprises a detent feature. In these embodiments, the detent figure aids in assembly of the actuator. In these embodiments, the actuator has an interference fit to the housing before first use in order to have the actuator sit proud of the valve for assembly. After first use, the actuator pushes from the detent, thereby allowing it to actuate the valve.

In some embodiments, the foldable trigger and handle are pivotable along one axis. In some embodiments, the foldable trigger and handle are pivotable along two axes. In some embodiments, the foldable trigger and handle are pivotable along three axes.

In many embodiments, the foldable trigger and handle are fully pivotable along at least one axis. In this regard, fully pivotable is understood to mean that the foldable trigger and handle can be pivoted between positions having opposite angles that are each parallel to the container assembly axis.

In some embodiments, the foldable trigger and handle are partially pivotable along at least one axis. In this regard, partially pivotable is understood to mean that the pivoting of the foldable trigger and handle are restricted such that full pivotability is not present. In some embodiments, the foldable trigger and handle are pivotable along at least one axis between an angle of 0° and 90° relative to the container assembly axis.

In many embodiments, the foldable trigger and handle are pivotable between a position that is aligned substantially parallel to a container assembly axis and a position that is aligned substantially non-parallel to a container assembly axis. In some embodiments, the foldable trigger and handle are pivotable along one axis between an angle of 0° and 90° relative to the container assembly axis.

In many embodiments, when the foldable handle is in its use position, a foldable trigger folds down. This allows the user to grip the foldable handle and activate the foldable trigger for application onto ceiling surfaces. In many embodiments, the foldable trigger is attached to an actuator through any suitable attachment means known in the art. In some embodiments, the foldable trigger is attached to an actuator with an attachment means selected from the group consisting of a snap feature, a slot, a living hinge, and combinations thereof.

In some embodiments, the foldable trigger is attached to an actuator through means of a snap feature. In these embodiments, the trigger can rotate about the actuator through a snap interface. The actuator is linearly guided in the housing and attaches to the valve. When the foldable trigger is pressed by the user at one end, it rotates about the actuator, and reacts against an actuator housing at the other end. When the foldable trigger is pressed, the slidable attachment to the actuator housing allows the actuator to move linearly along its guide ribs in the actuator housing. This provides for linear actuation of the valve via the rotating foldable trigger without having both the foldable trigger and actuator grounded to the actuator housing.

In many embodiments, when the foldable handle is in its non-use and/or stowed position, the foldable trigger rests in a vertical position. In operation, when the foldable trigger is rotated down and pressed, the valve on a container assembly is depressed, allowing material to flow into the actuator then out of the outlet assembly.

In some embodiments, the handle is hollow. In some embodiments, the handle is at least partially hollow. In some embodiments, the handle is solid.

In some embodiments, the handle is pivotably attached to a portion of the actuator housing. In some embodiments, the handle is pivotably attached to an exterior portion of the actuator housing. In some embodiments, the handle is pivotably attached to an interior portion of the actuator housing.

In some embodiments, the handle includes a spring portion along a left exterior edge and a spring portion along a right exterior edge. In some embodiments, an exterior portion of the actuator housing includes at least one push button, wherein the handle pivots about the at least one push button. In some embodiments, an exterior portion of the actuator housing includes a hinge portion including a left hinge portion, a central hinge portion, and/or a right hinge portion. In these embodiments, the left hinge portion and the right hinge portion each individually comprise at least two slots that are each individually configured to engage with the spring portion along a left exterior edge of the handle and the spring portion along a right exterior edge of the handle. In some embodiments, the handle snaps into the central hinge portion of the exterior portion of the actuator housing.

In some embodiments, the left hinge portion and the right hinge portion each individually comprise a button, wherein depression of both buttons allows the handle to rotate. In some embodiments, the left hinge portion and the right hinge portion each individually include a non-use slot that is aligned substantially parallel to a container assembly axis and a use slot that is aligned substantially non-parallel to a container assembly axis.

In some embodiments, depression of the trigger causes a portion of the trigger within the actuator housing to press against an interior surface of the actuator housing, wherein force resulting from the portion of the trigger within the actuator housing pressing against the interior surface of the actuator housing causes the linear movement of the actuator relative to the actuator housing.

The mechanism for actuation described herein is advantageous. This mechanism uses contact between the trigger and the housing to create a force balance that renders the force on the valve from the actuator substantially parallel to the can axis. This force balance improves actuation and decreases deterioration of the actuator over time associated with unbalanced forces.

In many embodiments, the actuator assembly is embodied by an actuator housing. The actuator housing provides a snap feature which allows the foldable handle to attach to it by means of a snap. After assembly to the housing, the foldable trigger and handle can rotate about the housing between two discrete positions. The two discrete positions are the non-use position and the use position. Two spring actuation features on the handle, one on each side, keep the handle in its discrete positions. The spring actuation features act as push buttons on the handle. When left alone, the spring actuation features push against mating geometry in the housing, keeping the foldable handle in place. Pushing the spring actuation features allows the mating geometry on the foldable handle to come out of contact with the mating geometry on the housing. Once the mating geometries are out of contact, the user can rotate the foldable handle from its non-use and/or stowed position to its use position, and vice versa.

In many embodiments, the actuator assembly may be connected to the container assembly through attachment mechanisms known in the art. Example attachment mechanisms include physical couplings, adhesives, overmolding, snap connections, and combinations thereof. In some embodiments, the actuator assembly snaps onto the container assembly. In some embodiments, the actuator assembly snaps onto the container assembly via a plurality of snap features. In some embodiments, the actuator assembly snaps onto the container assembly via a plurality of snap features and locating posts.

In some embodiments, the actuator is directly fluidically connected to the outlet opening. In some embodiments, the actuator assembly comprises a tube that fluidically connects the actuator and the outlet opening. Any suitable tube known in the art may be used. In some embodiments, the tube is composed of a plastic material. The tube can be made of known inflexible or flexible materials. Tubing made of flexible materials permits adjustment of the angle of the outlet with respect to the valve angle. In some embodiments, the tube is made of a material selected from the group consisting of fluoropolymers, polyolefins, silicones, rubbers, ethylene propylene diene terpolymer (EPDM) rubber, perfluoroalkoxy alkane (PFA), polytetrafluoroethylene (PTFE), vinyl polymers, polyvinyl chloride (PVC), polyethylene (PE), polypropylene (PP), and combinations thereof. The tube maintains fluidic connection between the actuator and the outlet opening.

In many embodiments, the container assembly comprises a container. In some embodiments, the container stores a texture material and a propellant material. The texture material and propellant material may be present separately or in a mixture. In some embodiments, the container stores a composition comprising a texture material and a propellant material.

In many embodiments, the texture material dispensing system is configured to deliver suitable texture materials while the container is in a substantially upright position. In some embodiments, the texture material dispensing system is configured to deliver suitable texture materials while the container is in an upright position. In some embodiments, the texture material dispensing system is configured to deliver suitable texture materials while the container is in a position that is between an upright position and a decline angle of less than 90° relative to the upright position. In some embodiments, the texture material dispensing system is configured to deliver suitable texture materials while the container is in a position that is between an upright position and a decline angle of 85° relative to the upright position. In some embodiments, the texture material dispensing system is configured to deliver suitable texture materials while the container is in a position that is between an upright position and a decline angle of 80° relative to the upright position. In some embodiments, the texture material dispensing system is configured to deliver suitable texture materials while the container is in a position that is between an upright position and a decline angle of 75° relative to the upright position. In some embodiments, the texture material dispensing system is configured to deliver suitable texture materials while the container is in a position that is between an upright position and a decline angle of 70° relative to the upright position. In some embodiments, the texture material dispensing system is configured to deliver suitable texture materials while the container is in a position that is between an upright position and a decline angle of 65° relative to the upright position. In some embodiments, the texture material dispensing system is configured to deliver suitable texture materials while the container is in a position that is between an upright position and a decline angle of 60° relative to the upright position. In some embodiments, the texture material dispensing system is configured to deliver suitable texture materials while the container is in a position that is between an upright position and a decline angle of 55° relative to the upright position. In some embodiments, the texture material dispensing system is configured to deliver suitable texture materials while the container is in a position that is between an upright position and a decline angle of 50° relative to the upright position. In some embodiments, the texture material dispensing system is configured to deliver suitable texture materials while the container is in a position that is between an upright position and a decline angle of 45° relative to the upright position. In some embodiments, the texture material dispensing system is configured to deliver suitable texture materials while the container is in a position that is between an upright position and a decline angle of 40° relative to the upright position. In some embodiments, the texture material dispensing system is configured to deliver suitable texture materials while the container is in a position that is between an upright position and a decline angle of 35° relative to the upright position. In some embodiments, the texture material dispensing system is configured to deliver suitable texture materials while the container is in a position that is between an upright position and a decline angle of 30° relative to the upright position. In some embodiments, the texture material dispensing system is configured to deliver suitable texture materials while the container is in a position that is between an upright position and a decline angle of 25° relative to the upright position. In some embodiments, the texture material dispensing system is configured to deliver suitable texture materials while the container is in a position that is between an upright position and a decline angle of 20° relative to the upright position. In some embodiments, the texture material dispensing system is configured to deliver suitable texture materials while the container is in a position that is between an upright position and a decline angle of 15° relative to the upright position. In some embodiments, the texture material dispensing system is configured to deliver suitable texture materials while the container is in a position that is between an upright position and a decline angle of 10° relative to the upright position. In some embodiments, the texture material dispensing system is configured to deliver suitable texture materials while the container is in a position that is between an upright position and a decline angle of 5° relative to the upright position.

In some embodiments, the texture material dispensing system is configured to deliver suitable texture materials while the container is in a position that is between an upright position and a decline angle of 60° relative to the upright position. In some embodiments, the texture material dispensing system is configured to deliver suitable texture materials while the container is in a position that is between an upright position and a decline angle of 30° relative to the upright position.

In many embodiments, the dispenser may be in the form of any suitable dispenser known in the art. In some embodiments, the dispenser is in a form selected from the group consisting of cans, canisters, bottles, containers, applicators, mechanical applicators, electric applicators, and pneumatic applicators. In some embodiments, the dispenser is a canister.

Generally, the texture material dispensing system is configured to deliver suitable texture materials known in the art. In many embodiments, the texture material dispensing system is configured for dispensing an aerosol comprising a texture material. In some embodiments, the aerosol comprises a texture material and a propellant.

Generally, any suitable texture material known in the art may be used in the texture dispensing system. Suitable texture materials known in the art are capable of delivering a variety of textures. In some embodiments, the texture material comprises a texture selected from the group consisting of a knockdown texture, an orange peel texture, a popcorn texture, and combinations thereof. In some particular embodiments, the texture material comprises a popcorn texture.

Generally, any suitable propellant known in the art may be used in the texture dispensing system. Suitable propellants known in the art are capable of delivering a variety of materials, including texture materials. In some embodiments, the propellant comprises a propellant selected from the group consisting of hydrocarbon propellants, A-85 propellant, ether propellants, dimethyl ether (DME) propellant, chlorofluorocarbon (CFC) propellants, hydroolefin (HFO) propellants, hydrofluorocarbon (HFC) propellants, and combinations thereof.

Generally, the texture material dispensing system is configured to deliver suitable texture materials to surfaces known in the art. In many embodiments, the texture material dispensing system is configured for dispensing a texture material onto a target surface. In some embodiments, the target surface is selected from the group consisting of a horizontal surface, a vertical surface, an angled surface, and combinations thereof. In some embodiments, the target surface is selected from the group consisting of a ceiling, a floor, a wall, an interior wall, an exterior wall, a construction surface, and combinations thereof.

In some particular embodiments, the target surface is a horizontal surface. In some embodiments, the target surface is a ceiling. In some embodiments, the surface is smooth. In some embodiments, the surface is rough. In some embodiments, the surface is pre-textured. In some embodiments, the surface has a texture consisting of a popcorn texture.

Aspects of the present disclosure are applicable to a variety of different types of assemblies, systems and methods involving dispensing of texture materials via aerosols from pressurized containers. Various embodiments are directed to a texture material dispensing system having a foldable trigger and handle which move to allow spraying of a spray texture material onto horizontal surfaces while maintaining the can in an upright or substantially upright position to create an ergonomic applicator. Such a system is readily adaptable to a variety of applications, uses, and environments.

Figure 1B:
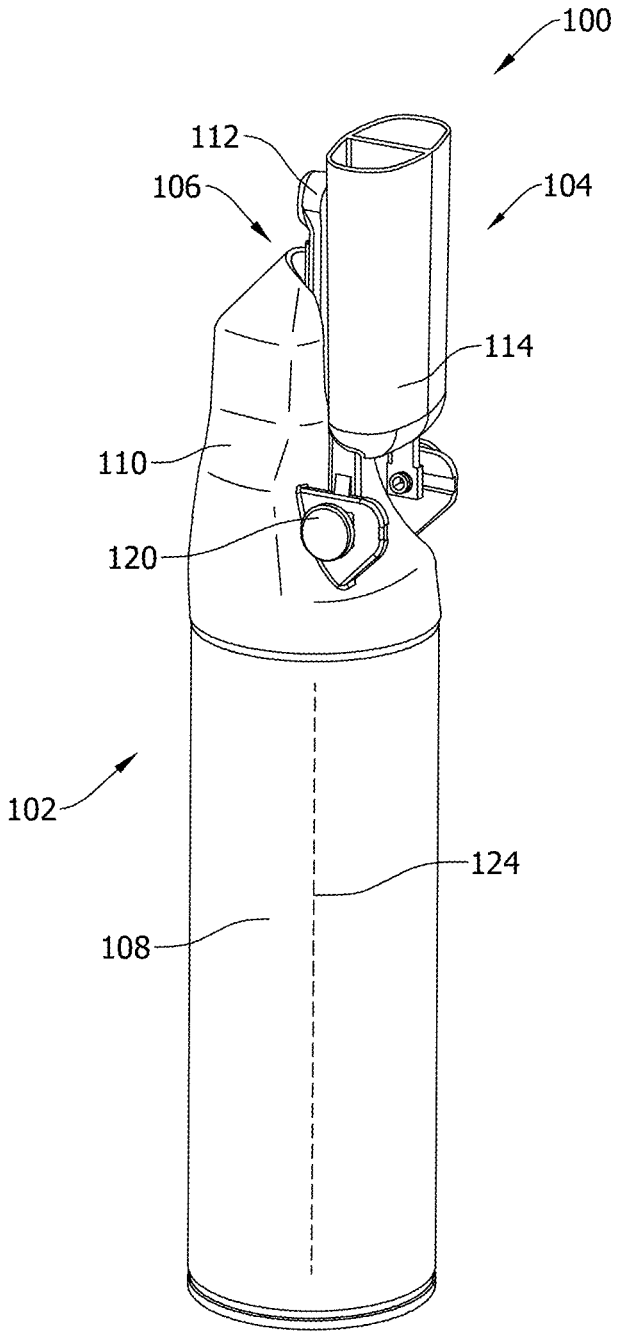
FIG. 1B shows a full view of the texture material dispensing system in accordance with the present disclosure shown in FIG. 1A in a non-use position.

Turning now to the figures, FIG. 1A and FIG. 1B show full views of an exemplary embodiment of a texture material dispensing system 100. FIG. 2A, FIG. 2B, FIG. 2C, and FIG. 2D show partial views of the texture material dispensing system 100 shown in FIG. 1A and FIG. 1B. FIG. 3A, FIG. 3B, and FIG. 3C show cross-sectional views of the texture material dispensing system 100 shown in FIG. 1A and FIG. 1B. FIG. 4A, FIG. 4B, FIG. 4C, and FIG. 4D show cross-sectional views of a second texture material dispensing system 200. FIG. 5A, FIG. 5B, FIG. 5C, and FIG. 5D show cross-sectional views of a second texture material dispensing system 300. FIG. 6A, FIG. 6B, FIG. 6C, and FIG. 6D show cross-sectional views of a third texture material dispensing system 400. FIG. 7A, FIG. 7B, FIG. 7C, and FIG. 7D show various views of a fourth texture material dispensing system 500.

Referring now to FIG. 1A and FIG. 1B, a texture material dispensing system 100 is shown. The texture material dispensing system 100 includes a container assembly 102, an actuator assembly 104, and an outlet assembly 106. The container assembly 102 includes a container 108 and a valve assembly (not shown) that store a texture material and a propellant material. The actuator assembly 104 includes an actuator housing 110 that houses an actuator 122, a foldable trigger 112 pivotably attached to the actuator 122, and a foldable handle 114 pivotably attached to an exterior portion of the actuator housing 110. The foldable handle shown here is hollow with a supporting beam dividing the foldable handle into equal internal halves. The outlet assembly 106 includes an outlet opening 116 that dispenses an aerosol including a texture material through an outlet tube 118 and onto a target surface, such as a ceiling, when the foldable trigger 112 is depressed. The texture may be a popcorn texture once dispensed onto the target surface. The tube 118 fluidically connects the actuator 122 and the outlet opening 116. When the foldable trigger is depressed, a pivoting movement of the foldable trigger 112 occurs relative to the actuator 122.

FIG. 1A shows the configuration of the texture dispensing system 100 in a use position. In the use position, a user holds the handle 114 and depresses the trigger 112 to cause texture material to be dispensed through the outlet assembly 106 onto the target surface. In the use position the foldable handle 114 and foldable trigger 112 are aligned substantially non-parallel, or orthogonal, to a container assembly axis 124.

FIG. 1B shows the configuration of the texture material dispensing system 100 in a non-use position. In the non-use position the foldable handle 114 and foldable trigger 112 are aligned substantially parallel to the container assembly axis 124. In the non-use position, the texture dispensing system 100 cannot be used by a user. To move the foldable handle 114 between the use and non-use position, a pair of buttons 120 are provided that the user squeezes in order to move the foldable handle 114 between the use position and the non-use position. The buttons 120 are connected to the foldable handle 114 after assembly of the foldable handle 114 to the actuator housing 110. The buttons may be connected to the foldable handle by a variety of means known in the art, including snapping into the foldable handle, glue, screws, ultrasonic welding, and combinations thereof.

Figure 2A:
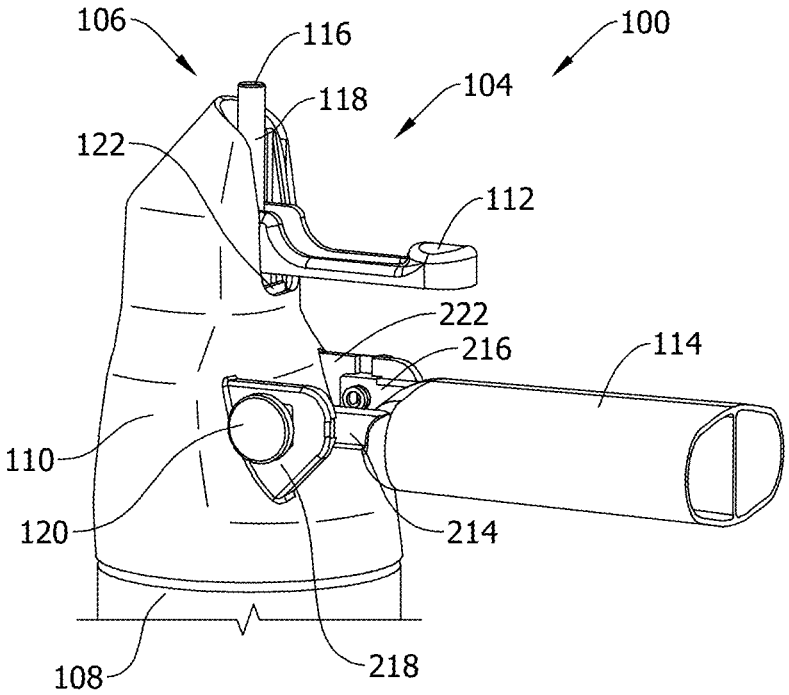
FIG. 2A shows a first partial view of the texture material dispensing system in accordance with the present disclosure shown in FIG. 1A in a use position.
Figure 2B:
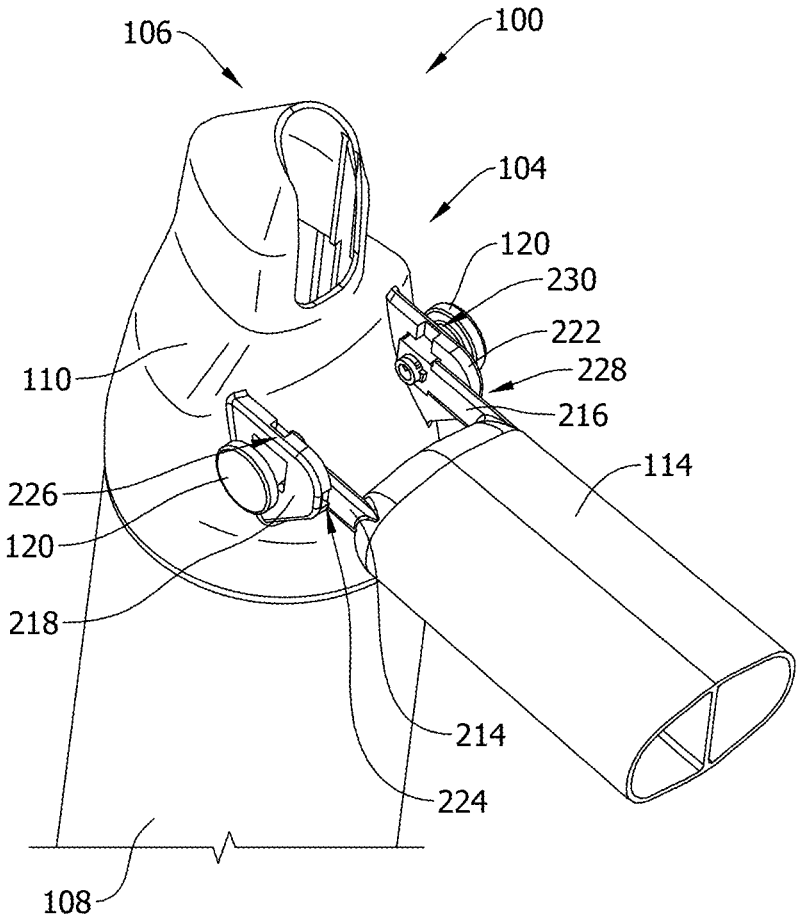
FIG. 2B shows a second partial view of the texture material dispensing system in accordance with the present disclosure shown in FIG. 1A in a use position.
Figure 2C:
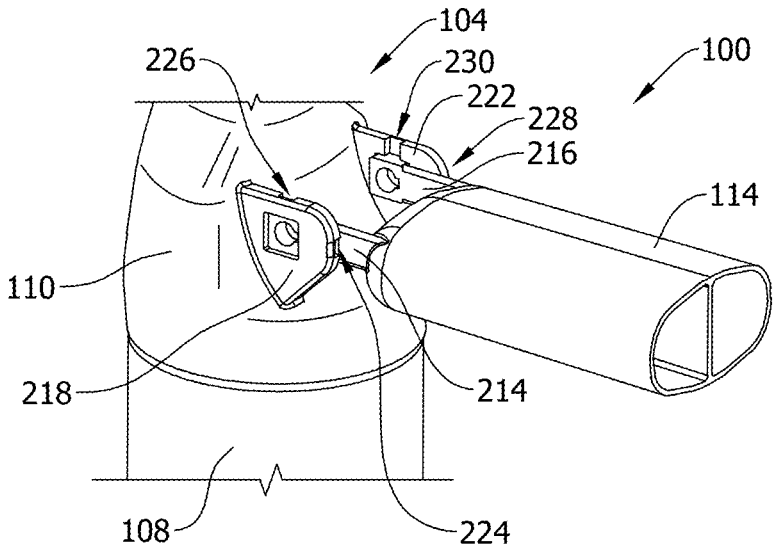
FIG. 2C shows a third partial view of the texture material dispensing system shown in FIG. 1A in a use position in accordance with the present disclosure.
Figure 2D:
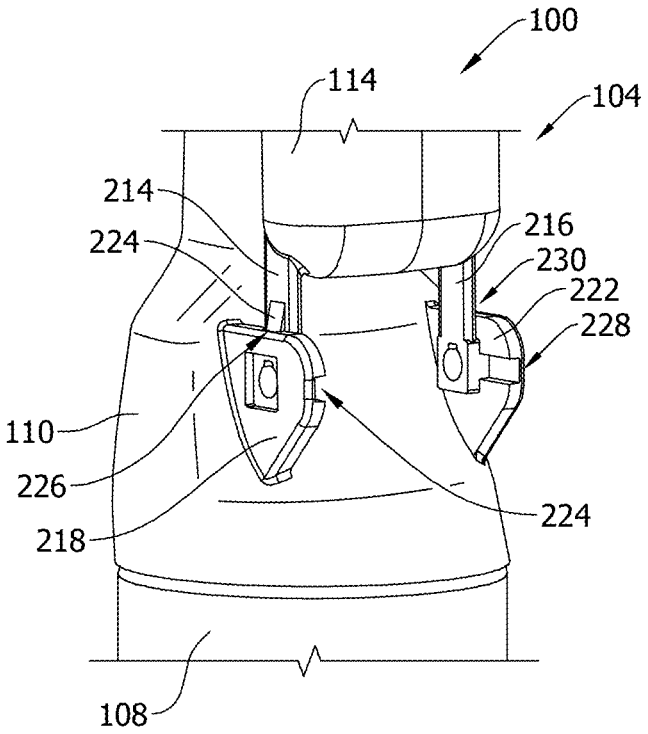
FIG. 2D shows a partial view of the texture material dispensing system in accordance with the present disclosure shown in FIG. 1A in a non-use position.
Figure 3A:
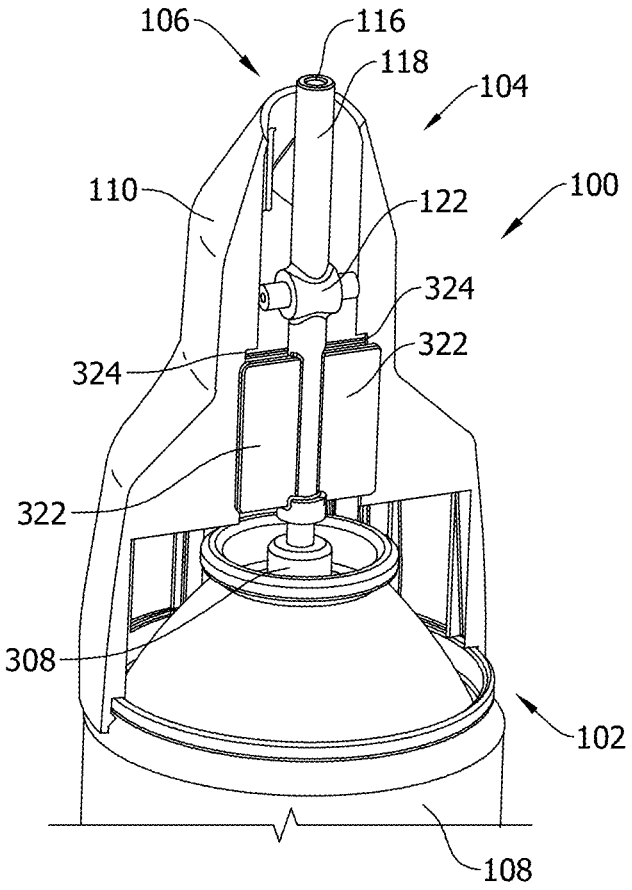
FIG. 3A shows a first cross-sectional view of the texture material dispensing system in accordance with the present disclosure shown in FIG. 1A.
Figure 3B:
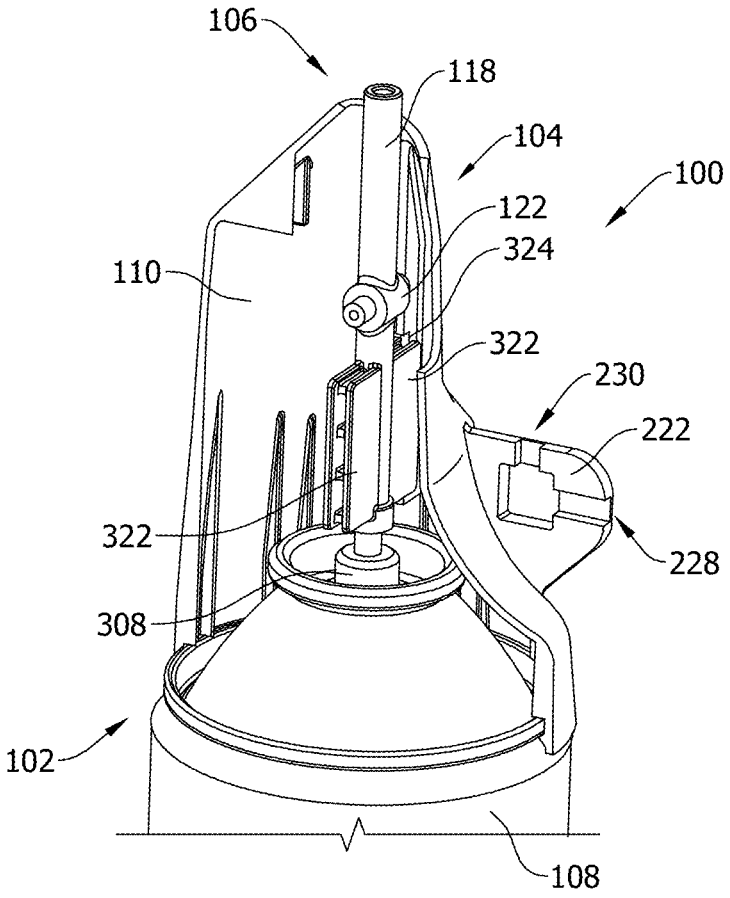
FIG. 3B shows a second cross-sectional view of the texture material dispensing system in accordance with the present disclosure shown in FIG. 1A.
Figure 3C:
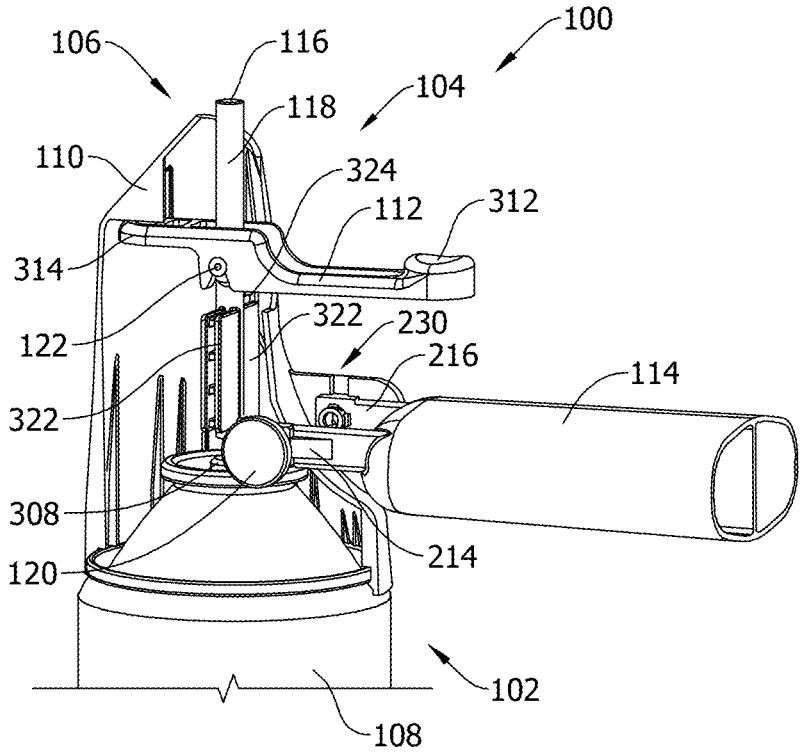
FIG. 3C shows a third cross-sectional view of the texture material dispensing system in accordance with the present disclosure shown in FIG. 1A.
Figure 4A:
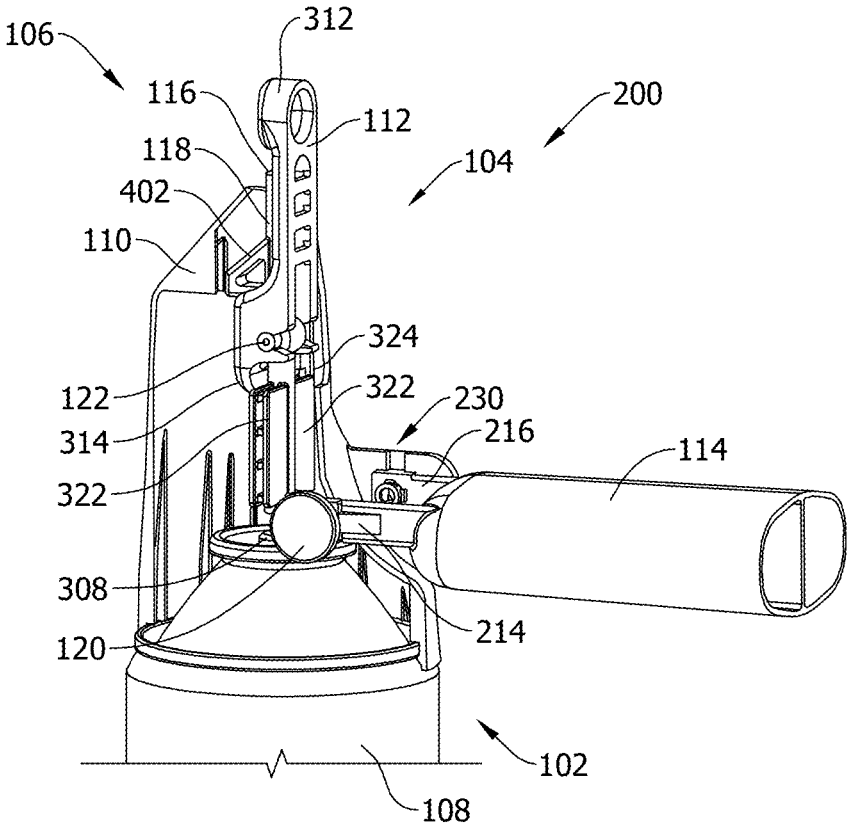
FIG. 4A shows a first cross-sectional view of a second texture material dispensing system in accordance with the present disclosure.
Figure 4B:
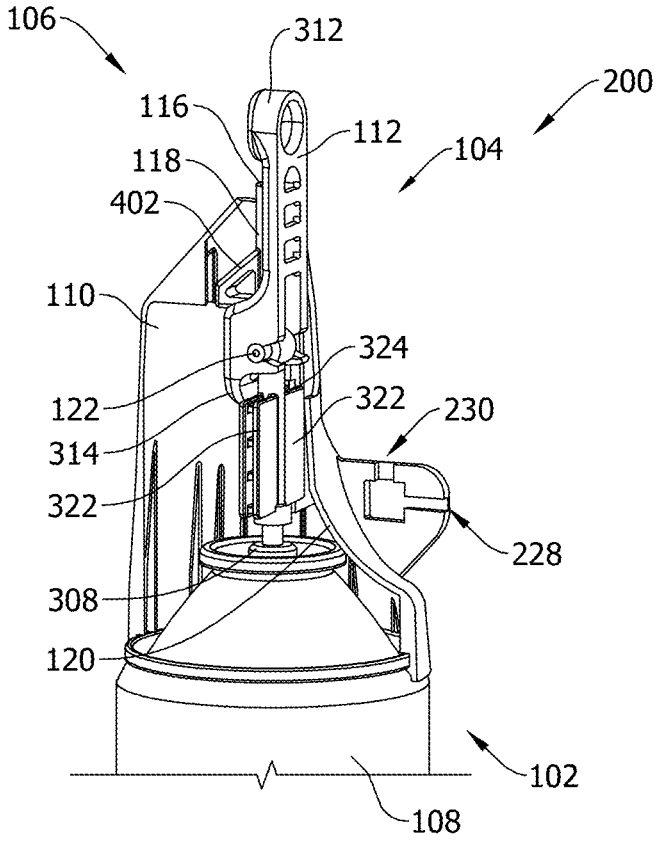
FIG. 4B shows a second cross-sectional view of the texture material dispensing system in accordance with the present disclosure shown in FIG. 4A.
Figure 4C:
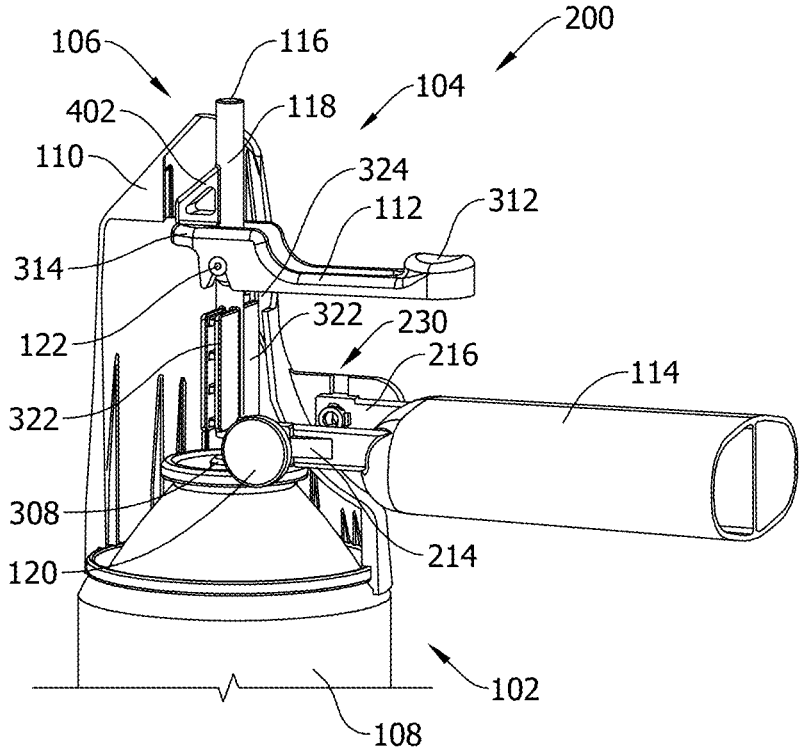
FIG. 4C shows a third cross-sectional view of the texture material dispensing system in accordance with the present disclosure shown in FIG. 4A.
Figure 4D:
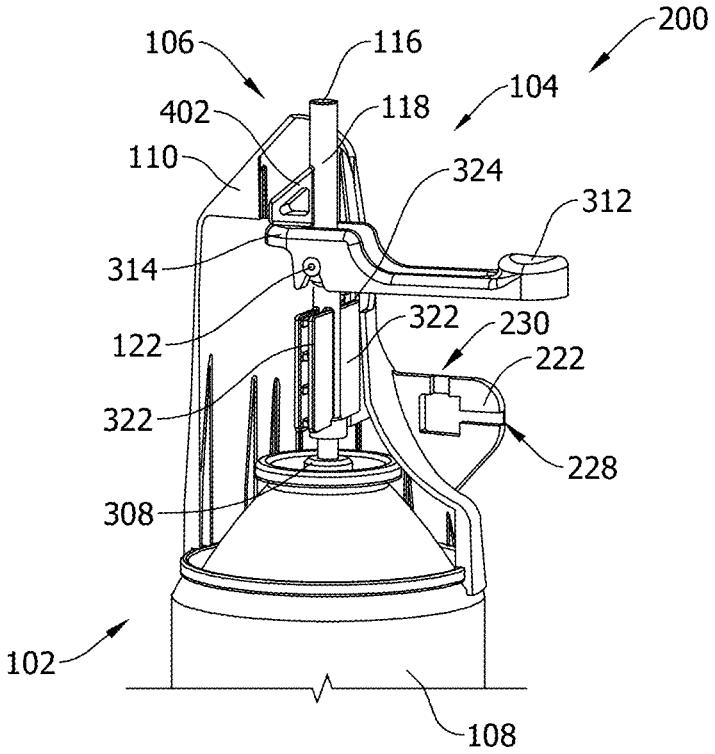
FIG. 4D shows a fourth cross-sectional view of the texture material dispensing system in accordance with the present disclosure shown in FIG. 4A.
Figure 5A:
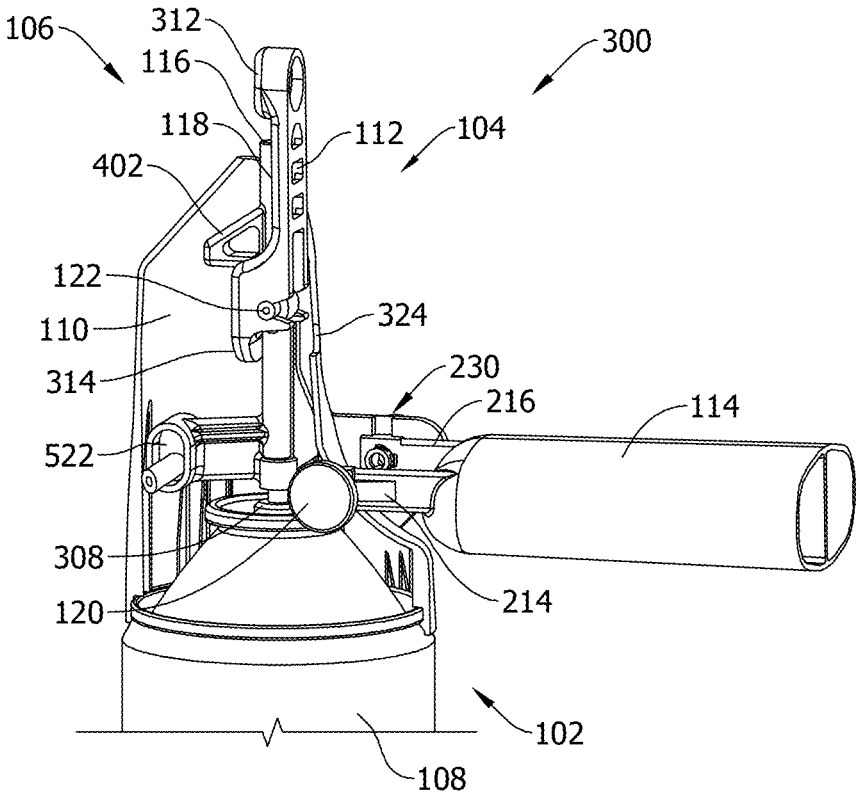
FIG. 5A shows a first cross-sectional view of a third texture material dispensing system in accordance with the present disclosure.
Figure 5B:
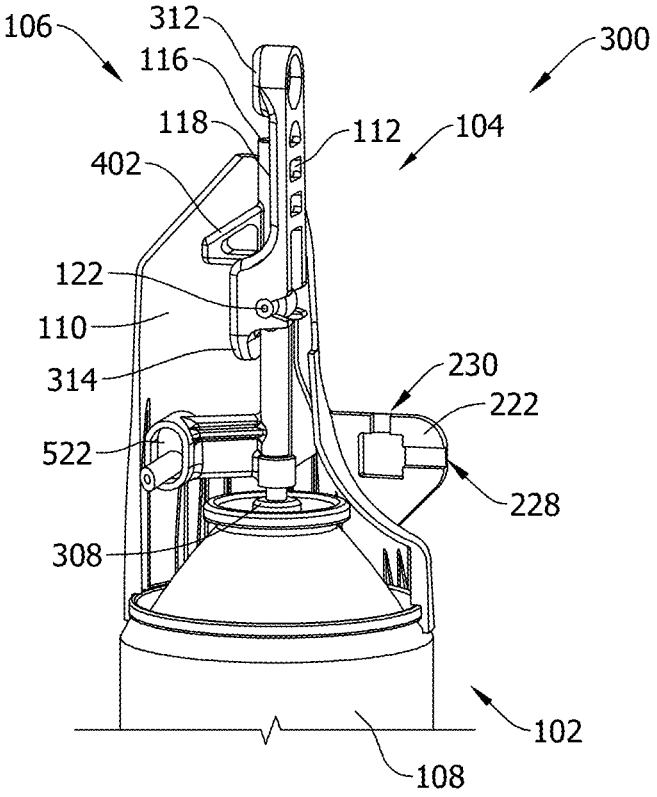
FIG. 5B shows a second cross-sectional view of the texture material dispensing system in accordance with the present disclosure shown in FIG. 5A.
Figure 5C:
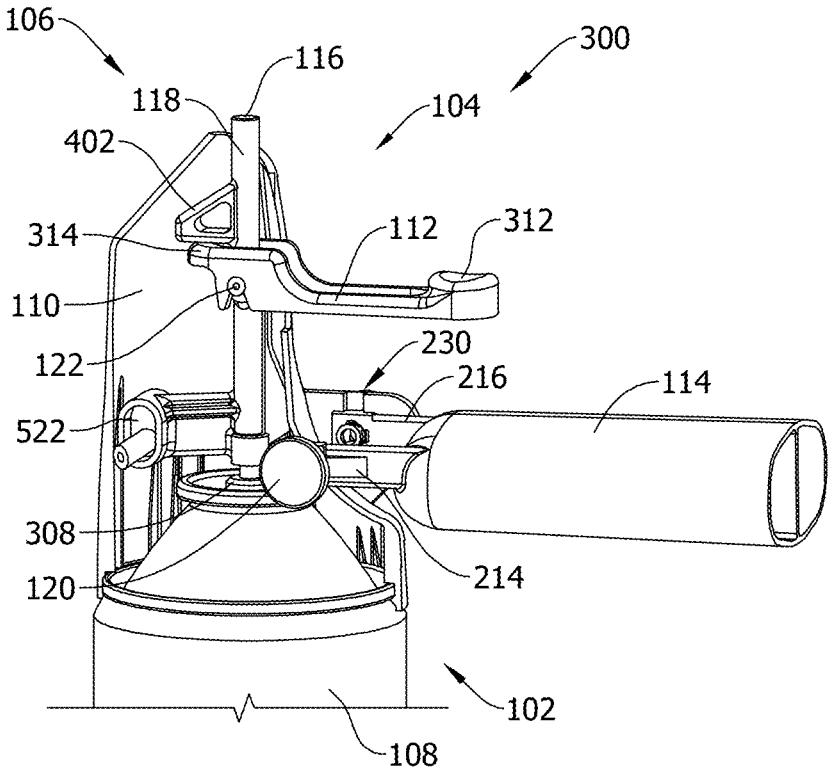
FIG. 5C shows a third cross-sectional view of the texture material dispensing system in accordance with the present disclosure shown in FIG. 5A.
Figure 5D:
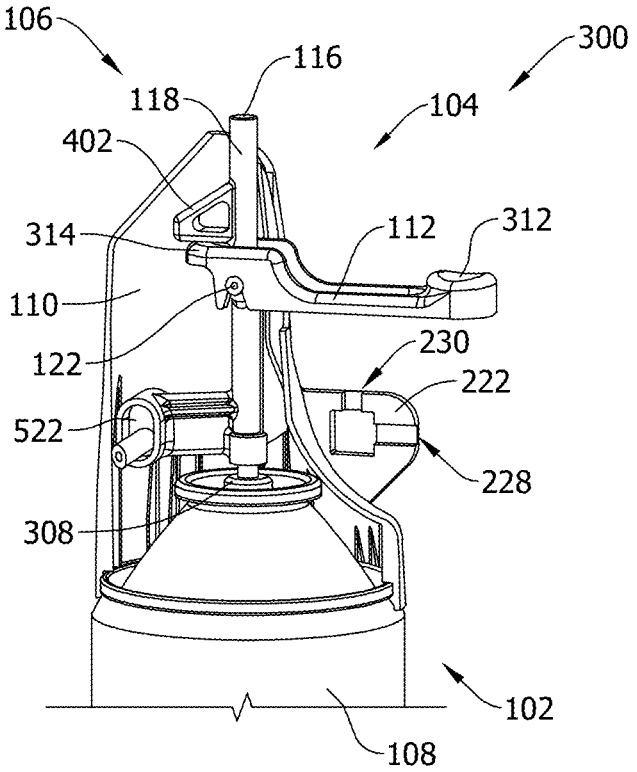
FIG. 5D shows a fourth cross-sectional view of the texture material dispensing system in accordance with the present disclosure shown in FIG. 5A.
Figure 6A:
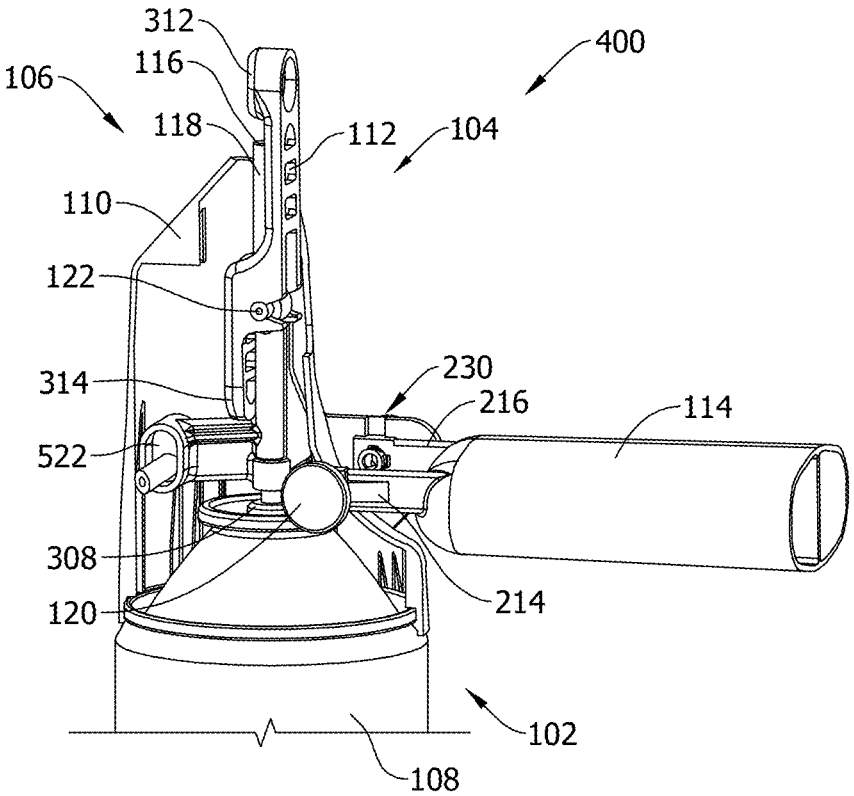
FIG. 6A shows a first cross-sectional view of a fourth texture material dispensing system in accordance with the present disclosure.
Figure 6B:
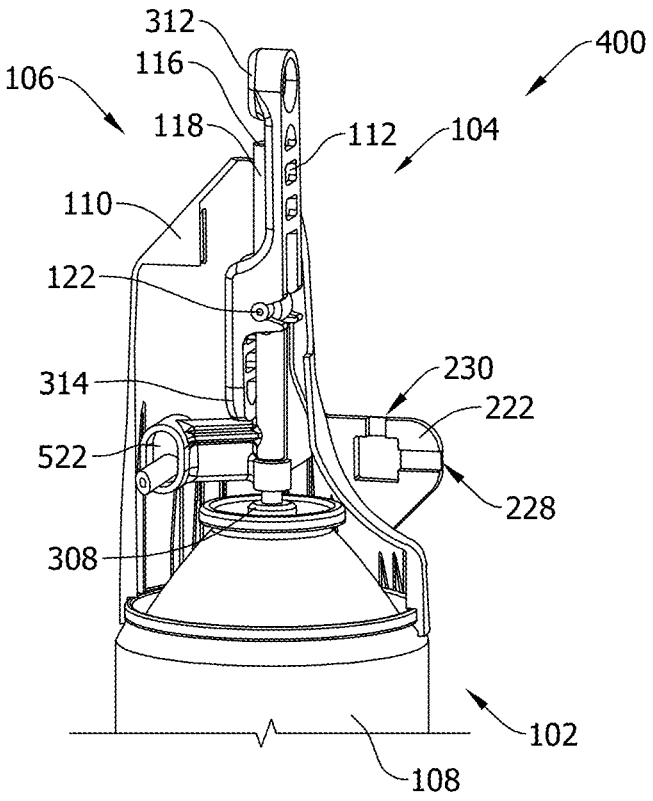
FIG. 6B shows a second cross-sectional view of the texture material dispensing system in accordance with the present disclosure shown in FIG. 6A.
Figure 6C:
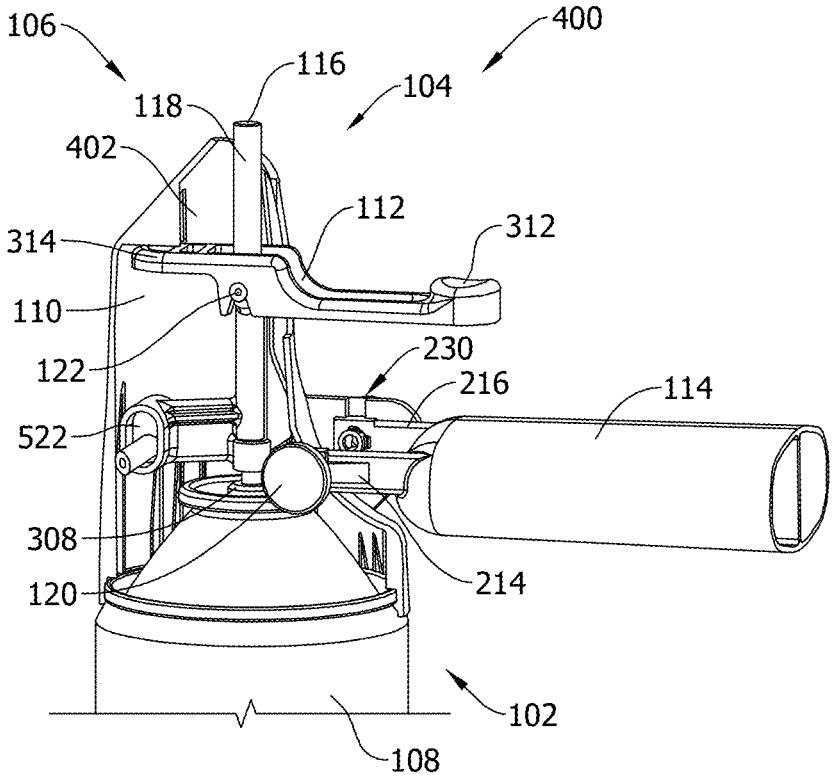
FIG. 6C shows a third cross-sectional view of the texture material dispensing system in accordance with the present disclosure shown in FIG. 6A.
Figure 6D:
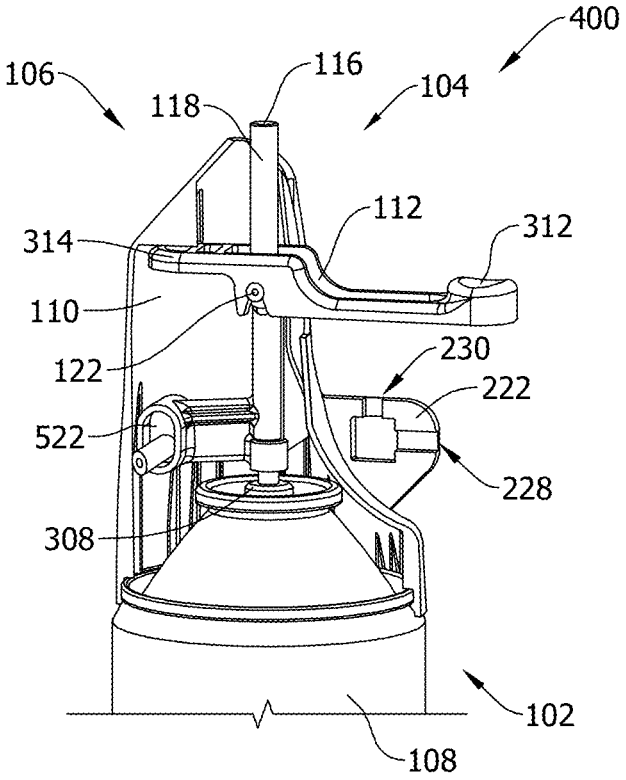
FIG. 6D shows a fourth cross-sectional view of the texture material dispensing system in accordance with the present disclosure shown in FIG. 6A.

Referring now to FIG. 2A, FIG. 2B, FIG. 2C, and FIG. 2D, the exterior aspects of the actuator assembly 104 and the outlet assembly 106 of the texture material dispensing system 100 from FIG. 1A and FIG. 1B are shown in greater detail. The foldable handle 114 of the actuator assembly 104 has a first spring 214 along a left exterior edge of the foldable handle 114 and a second spring 216 along the right exterior edge of the foldable handle 114. The exterior portion of the actuator housing 110 includes a left hinge portion 218 and a right hinge portion 222. The left hinge portion 218 includes a left hinge first slot 224 and a left hinge second slot 226. The right hinge portion 218 includes a right hinge first slot 228 and a right hinge second slot 230. The first spring 214 and the second spring 216 of the foldable handle 114 mate with the slots on the housing 110 to act as detents for the foldable handle 114 positions of use and non-use. In other words, all the slots 224, 226, 228, 230 are each individually configured to engage with the springs 214, 216 along the left and right exterior edges of foldable handle 114. FIG. 2B and FIG. 2C show the use position for the texture material dispensing system 100 where the first spring 214 and the second spring 216 of the foldable handle 114 mate with the left hinge first slot 224 and the right hinge first slot 228 of the actuator housing 110, respectively. In other words, the left hinge first slot 224 and the right hinge first slot 228 may be use slots that are aligned substantially non-parallel or orthogonal to the container assembly axis 124 shown in FIG. 1A and FIG. 1B. Similarly, the left hinge second slot 226 and the right hinge second slot 230 may be non-use slots that are aligned substantially parallel to the container assembly axis 124 shown in FIG. 1A and FIG. 1B. FIG. 2D shows the non-use position for the texture material dispensing system 100. All the springs 214, 216 are preloaded into the actuator housing 110 to provide for a rigid connection. In some embodiments, the non-use position is the stowed position for shipping the texture material dispensing system 100. In the use position, the rigid connection of the springs 214, 216 loaded into the actuator housing 110 provides a rigid connection for an ergonomic position for dispensing texture onto a target surface, such as a ceiling. The left hinge portion 218 and the right hinge portion 222 both include the buttons 120, wherein depression of both buttons 120 simultaneously allows the foldable handle 114 to rotate from a use position shown in FIG. 2A, FIG. 2B, and FIG. 2C to a non-use position shown in FIG. 2D. Regarding FIG. 2C and FIG. 2D, the actuator assembly 104 is shown here without the buttons 120. FIG. 2A shows the foldable trigger 112 while FIG. 2B, FIG. 2C, and FIG. 2D do not show the foldable trigger 112.

Referring now to FIG. 3A, FIG. 3B, and FIG. 3C, the interior aspects of the actuator assembly 104 and the outlet assembly 106 of the texture material dispensing system 100 from FIG. 1A and FIG. 1B are shown in greater detail. The actuator 122 is slidably supported relative to the actuator housing 110. This is accomplished via mating ribs 322 sliding linearly along rail portions 324 in the interior portion of the actuator housing 110. The rail portions 324 include hard-stops that interface with the mating ribs 322 to prevent the actuator from moving out of the housing.

The container assembly 102 includes the container 108 of texture material and a container valve 308. When the texture dispensing system 100 is in use, texture material flows from the container 108, through the container valve 308, into the actuator 122, through the outlet tube 118, and finally out of the outlet opening 116 of the outlet assembly 106 onto the target surface, such as a ceiling. In other embodiments, the actuator 122 is directly fluidically connected to the outlet opening 116 that avoids utilizing the outlet tube 118. The actuator housing 110 snaps directly to the container 108 of the container assembly 102. The actuator 122 and the outlet tube 118 in this embodiment are one piece and the actuator 122 extends to replace the tubing that was removed. As shown in FIG. 3C, the foldable trigger 112 snaps to the actuator 122. The foldable trigger 112 is pivotably attached to the actuator 122 and folds into use and non-use positions. When the foldable trigger 112 is pressed or depressed at a first trigger location 312 the foldable trigger 112 can slide at a second trigger location 314 which forces the actuator 122 down along the mating ribs 322. This depresses the container valve 308, thus allowing for texture material to flow through the texture dispensing system 100 to the outlet opening 116 onto a target surface, such as a ceiling. In other words, pivoting movement of the foldable trigger 112 relative to the actuator 122 causes linear movement of the actuator 122 relative to the actuator housing 110. The linear movement of the actuator 122 engages the container valve 308 to alter the container valve 308 from a closed configuration to an open configuration. In other words, depression of the foldable trigger 112 causes a portion of the foldable trigger 112 in the actuator housing 110 to press against an interior surface of the actuator housing 110. Force resulting from the portion of the foldable trigger 112 within the actuator housing 110 pressing against the interior surface of the actuator housing 110 causes the linear movement of the actuator 122 relative to the actuator housing 110.

Referring now to FIG. 4A, FIG. 4B, FIG. 4C, and FIG. 4D, an embodiment of a texture material dispensing system 200 is shown. The texture material dispensing system 200 includes a stop 402 attached to the outlet tube 118. Pivoting movement of the foldable trigger 112 relative to the actuator 122 causes linear movement of the actuator 122 relative to the actuator housing 110 and the linear movement of the actuator 122 engages the container valve 308 to alter the container valve 308 from a closed configuration to an open configuration. In this embodiment, the force resulting from the portion of the foldable trigger 112 pressing against the stop 402 causes the linear movement of the actuator 122 relative to the actuator housing 110. This is unlike the system 100 where the foldable trigger 112 presses against the interior surface of the actuator housing 110. In other words, the foldable trigger 112 does not interact with the housing 110 and interacts solely with the actuator 122 via the stop 402 attached to the outlet tube 118 in the actuator assembly 104.

Referring now to FIG. 5A, FIG. 5B, FIG. 5C, and FIG. 5D, an embodiment of a texture material dispensing system 300 is shown. The texture material dispensing system 300 includes the stop 402 attached to the outlet tube 118 part of the actuator assembly 104 so the foldable trigger does not interact with the housing 110. Additionally, the texture material dispensing system 300 further includes a pivoting portion 522 of the actuator 122 that pivots or moves annularly when depression of the foldable trigger 112 causes a portion of the foldable trigger 112 in the actuator housing 110 to press against the stop 402. Instead of a linear movement, a pivoting or annular movement occurs, thereby causing the pivoting portion 522 to pivot or move annularly in relation to the container 108. The pivoting movement of the pivoting portion 522 engages the container valve 308 to alter the container valve 308 from a closed configuration to an open configuration. In this embodiment, the actuator assembly 104 functions as a pivoting actuator. In this embodiment, the foldable trigger 112 does not interact with the housing 110 and interacts solely via the stop 402 attached to the outlet tube 118 in the actuator assembly 104.

Referring now to FIG. 6A, FIG. 6B, FIG. 6C, and FIG. 6D, an embodiment of a texture material dispensing system 400 is shown. In this embodiment, depression of the foldable trigger 112 causes a portion of the foldable trigger 112 in the actuator housing 110 to press against an interior surface of the actuator housing 110. Force resulting from the portion of the foldable trigger 112 within the actuator housing 110 pressing against the interior surface of the actuator housing 110 causes pivoting or annular movement of a pivoting portion 522 relative to the actuator housing 110. The pivoting movement of the pivoting portion 522 engages the container valve 308 to alter the container valve 308 from a closed configuration to an open configuration. In this embodiment, the actuator assembly 104 functions as a pivoting actuator.

Figure 7A:
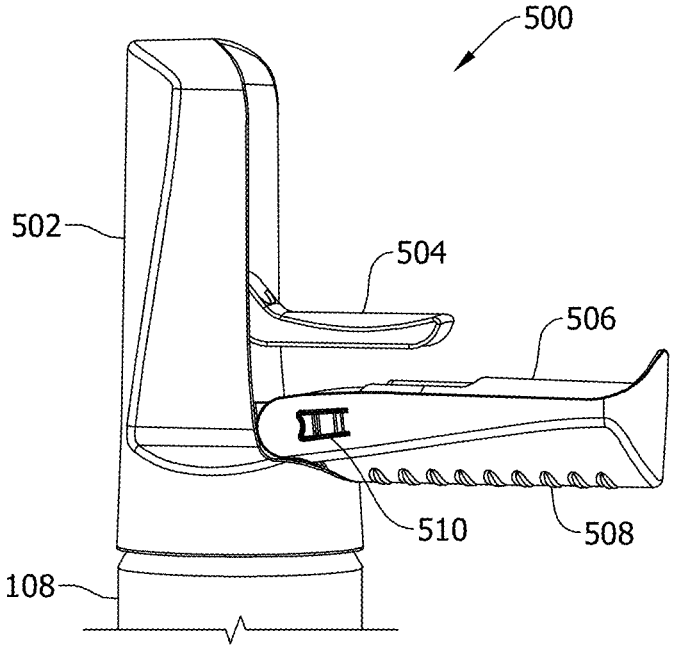
FIG. 7A shows a partial view of a texture material dispensing system in accordance with the present disclosure in a use position.
Figure 7B:
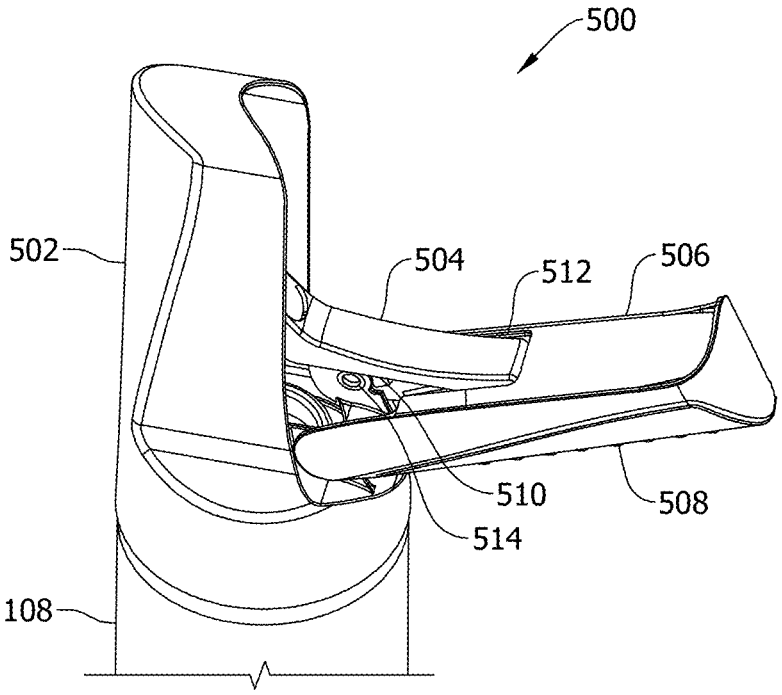
FIG. 7B shows a partial view of a texture material dispensing system in accordance with the present disclosure between a use position and a non-use position.
Figure 7C:
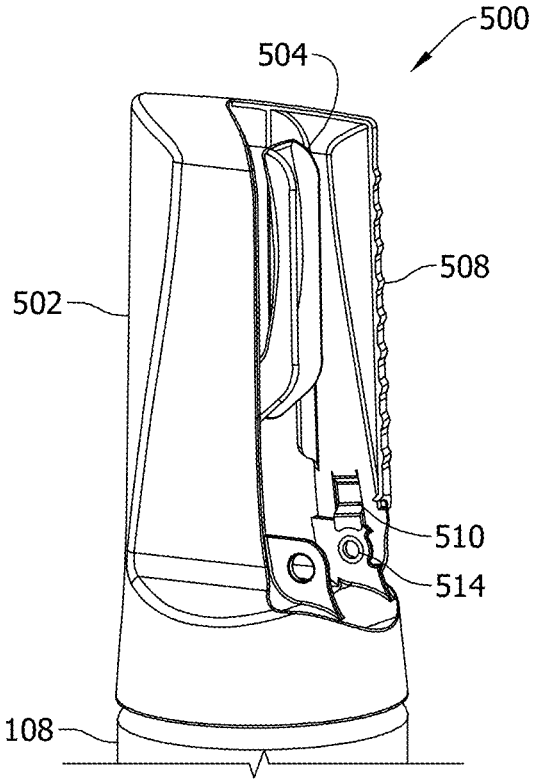
FIG. 7C shows a cross-sectional view of a texture material dispensing system in accordance with the present disclosure in a non-use position.
Figure 7D:
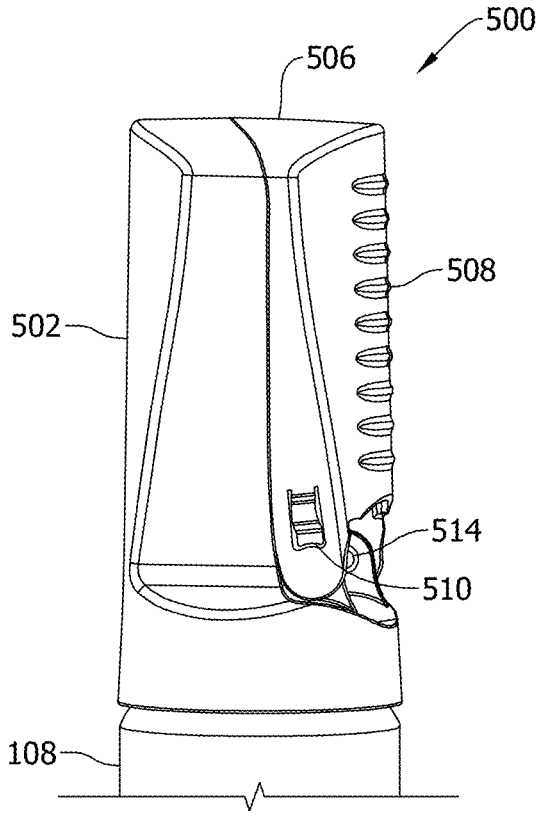
FIG. 7D shows a partial view of a texture material dispensing system in accordance with the present disclosure in a non-use position.

Referring now to FIG. 7A, FIG. 7B, FIG. 7C, and FIG. 7D, an embodiment of a texture material dispensing system 500 is shown. In this embodiment, the texture material dispensing system 500 has a foldable handle 506 and foldable trigger 504. This embodiment relates to the configuration of the foldable handle 506 and the foldable trigger 504 and does not limit the actuation mechanism. The foldable handle 506 has an ergonomic grip 508 and a mechanism 510 (e.g. a push button) that is depressed to release the foldable handle 506 from the actuator housing 502. The actuator housing 502 is connected to the container 108. FIG. 7A shows that the foldable handle 506 and the foldable trigger 504 fold out of the actuator housing 502. FIG. 7B shows the texture material dispensing system 500 in between a use position and a non-use position. When folded in a non-use position, the foldable trigger 504 fits into a slot 512 in the foldable handle 506, and the foldable handle 506 folds against, and connects with, the actuator housing 502. FIG. 7C shows a cross-sectional view of the texture material dispensing system 500 in a non-use position. The foldable trigger 504 is contained within the foldable handle 506 that is folded against the actuator housing 502. A partial view of the non-use position is shown in FIG. 7D. Depression of the mechanism 510 allows the foldable handle 506 to pivot on a hinge 514.

In this embodiment, the foldable handle 506 connects (e.g. snaps) directly onto the actuator housing 502 via posts on the foldable handle 506 (not shown). The handle posts mate with holes in the housing 514 which allow the handle to rotate about the actuator housing 502. The handle has mechanism 510 molded into it. The mechanism 510 acts a spring. When the mechanism 510 is depressed, it allows the foldable handle 506 to move freely between non-use and use positions. The actuator housing 502 has grooves cut in it (not shown). When the foldable handle 506 is pulled into the use position, the mechanism 510 engages with the groove and locks into place for use. The same groove may be present for locking the foldable handle 506 in the non-use position. When the foldable handle 506 is folded down from the non-use position into the use position, a rib (not shown) on the foldable handle 506 engages the foldable trigger 504 and pulls the foldable trigger 504 down into its use position. When the foldable handle 506 is folded up from the use position into the non-use position, a second rib (not shown) on the foldable handle 506 engages the foldable trigger 504 and pushes it back into its non-use position. In this way, a user only has to engage the foldable handle 506 and never has to fold the foldable trigger 504 up or down.

The embodiments of this disclosure include:

Embodiment 1. A texture material dispensing system comprising:

a container assembly comprising a container and a valve assembly;

an actuator assembly comprising:

an actuator housing comprising an actuator that is slidably supported relative to the actuator housing by at least one rail portion;

a trigger pivotably attached to the actuator; and a handle pivotably attached to a portion of the actuator housing; and an outlet assembly comprising an outlet opening;

wherein depression of the trigger causes pivoting movement of the trigger relative to the actuator;

wherein the pivoting movement of the trigger relative to the actuator causes linear movement of the actuator relative to the actuator housing; and wherein the linear movement of the actuator engages the valve assembly to alter the valve assembly from a closed configuration to an open configuration.

Embodiment 2. The texture material dispensing system of embodiment 1, wherein the texture material dispensing system is configured for dispensing an aerosol comprising a texture material.

Embodiment 3. The texture material dispensing system of embodiment 1, wherein the texture material dispensing system is configured for dispensing a texture material onto a target surface.

Embodiment 4. The texture material dispensing system of embodiment 1, wherein the texture material dispensing system is configured to dispense a texture material when a user holds the handle and depresses the trigger member.

Embodiment 5. The texture material dispensing system of embodiment 1, wherein the texture material dispensing system is configured to dispense a texture material when a user simultaneously holds the handle and depresses the trigger member with a single hand.

Embodiment 6. The texture material dispensing system of embodiment 1, wherein the trigger is foldable between a non-use position that is aligned substantially parallel to the container assembly axis and a use position that is aligned substantially non-parallel to the container assembly axis.

Embodiment 7. The texture material dispensing system of embodiment 1, wherein the handle is foldable between a non-use position that is aligned substantially parallel to a container assembly axis and a use position that is aligned substantially non-parallel to a container assembly axis.

Embodiment 8. The texture material dispensing system of embodiment 7, wherein the handle prevents accidental actuation of the trigger when it is folded in the non-use position that is aligned substantially parallel to a container assembly axis.

Embodiment 9. The texture material dispensing system of embodiment 1, wherein the handle is hollow.

Embodiment 10. The texture material dispensing system of embodiment 1, wherein the handle comprises a spring portion along a left exterior edge and a spring portion along a right exterior edge.

Embodiment 11. The texture material dispensing system of embodiment 10, wherein the portion of the actuator housing is an exterior portion of the actuator housing.

Embodiment 12. The texture material dispensing system of embodiment 11, wherein the exterior portion of the actuator housing comprises a hinge portion comprising a left hinge portion and a right hinge portion; wherein the left hinge portion and the right hinge portion each individually comprise at least two slots that are each individually configured to engage with the spring portion along a left exterior edge of the handle and the spring portion along a right exterior edge of the handle.

Embodiment 13. The texture material dispensing system of embodiment 12, wherein the left hinge portion and the right hinge portion each individually comprise a button, wherein depression of both buttons allows the handle to rotate.

Embodiment 14. The texture material dispensing system of embodiment 12, wherein the left hinge portion and the right hinge portion each individually comprise a non-use slot that is aligned substantially parallel to a container assembly axis and a use slot that is aligned substantially non-parallel to a container assembly axis.

Embodiment 15. The texture material dispensing system of embodiment 1, wherein the depression of the trigger causes a portion of the trigger within the actuator housing to press against an interior surface of the actuator housing, wherein force resulting from the portion of the trigger within the actuator housing pressing against the interior surface of the actuator housing causes the linear movement of the actuator relative to the actuator housing.

Embodiment 16. The texture material dispensing system of embodiment 1, wherein the actuator assembly comprises a tube that fluidically connects the actuator and the outlet opening.

Embodiment 17. The texture material dispensing system of embodiment 1, wherein the actuator is directly fluidically connected to the outlet opening.

Embodiment 18. The texture material dispensing system of embodiment 1, wherein the container stores a texture material and a propellant material.

Embodiment 19. A method of using a texture material dispensing system comprising:

a container assembly comprising a container and a valve assembly;

an actuator assembly comprising:

an actuator housing comprising an actuator that is slidably supported relative to the actuator housing by at least one rail portion;

a trigger pivotably attached to the actuator; and a handle pivotably attached to a portion of the actuator housing; and an outlet assembly comprising an outlet opening;

wherein depression of the trigger causes pivoting movement of the trigger relative to the actuator;

wherein the pivoting movement of the trigger relative to the actuator causes linear movement of the actuator relative to the actuator housing; and wherein the linear movement of the actuator engages the valve assembly to alter the valve assembly from a closed configuration to an open configuration, the method comprising using the texture material dispensing system for dispensing a texture material onto a target surface.

Embodiment 20. The method of embodiment 18, wherein the target surface is a ceiling.

Embodiment 21. The method of embodiment 18, wherein the method dispenses a popcorn texture onto the target surface.

Embodiment 22. A texture material dispensing system comprising:

a container assembly comprising a container and a valve assembly;

an actuator assembly comprising:

an actuator housing comprising a pivoting actuator;

a trigger pivotably attached to the pivoting actuator; and a handle pivotably attached to a portion of the actuator housing; and an outlet assembly comprising an outlet opening;

wherein depression of the trigger causes pivoting movement of the trigger relative to the pivoting actuator;

wherein the pivoting movement of the trigger relative to the pivoting actuator causes pivoting movement of the pivoting actuator relative to the actuator housing; and wherein the pivoting movement of the pivoting actuator engages the valve assembly to alter the valve assembly from a closed configuration to an open configuration.

Embodiment 23. The texture material dispensing system of embodiment 22, wherein the texture material dispensing system is configured for dispensing an aerosol comprising a texture material.

Embodiment 24. The texture material dispensing system of embodiment 22, wherein the texture material dispensing system is configured for dispensing a texture material onto a target surface.

Embodiment 25. The texture material dispensing system of embodiment 22, wherein the texture material dispensing system is configured to dispense a texture material when a user holds the handle and depresses the trigger member.

Embodiment 26. The texture material dispensing system of embodiment 22, wherein the texture material dispensing system is configured to dispense a texture material when a user simultaneously holds the handle and depresses the trigger member with a single hand.

Embodiment 27. The texture material dispensing system of embodiment 22, wherein the trigger is foldable between a non-use position that is aligned substantially parallel to the container assembly axis and a use position that is aligned substantially non-parallel to the container assembly axis.

Embodiment 28. The texture material dispensing system of embodiment 22, wherein the handle is foldable between a non-use position that is aligned substantially parallel to a container assembly axis and a use position that is aligned substantially non-parallel to a container assembly axis.

Embodiment 29. The texture material dispensing system of embodiment 28, wherein the handle prevents accidental actuation of the trigger when it is folded in the non-use position that is aligned substantially parallel to a container assembly axis.

Embodiment 30. The texture material dispensing system of embodiment 22, wherein the handle is hollow.

Embodiment 31. The texture material dispensing system of embodiment 22, wherein the handle comprises a spring portion along a left exterior edge and a spring portion along a right exterior edge.

Embodiment 32. The texture material dispensing system of embodiment 31, wherein the portion of the actuator housing is an exterior portion of the actuator housing.

Embodiment 33. The texture material dispensing system of embodiment 32, wherein the exterior portion of the actuator housing comprises a hinge portion comprising a left hinge portion and a right hinge portion; wherein the left hinge portion and the right hinge portion each individually comprise at least two slots that are each individually configured to engage with the spring portion along a left exterior edge of the handle and the spring portion along a right exterior edge of the handle.

Embodiment 34. The texture material dispensing system of embodiment 33, wherein the left hinge portion and the right hinge portion each individually comprise a button, wherein depression of both buttons allows the handle to rotate.

Embodiment 35. The texture material dispensing system of embodiment 33, wherein the left hinge portion and the right hinge portion each individually comprise a non-use slot that is aligned substantially parallel to a container assembly axis and a use slot that is aligned substantially non-parallel to a container assembly axis.

Embodiment 36. The texture material dispensing system of embodiment 22, wherein the depression of the trigger causes a portion of the trigger within the actuator housing to press against an interior surface of the actuator housing, wherein force resulting from the portion of the trigger within the actuator housing pressing against the interior surface of the actuator housing causes the pivoting movement of the pivoting actuator relative to the actuator housing.

Embodiment 37. The texture material dispensing system of embodiment 22, wherein the actuator assembly comprises a tube that fluidically connects the pivoting actuator and the outlet opening.

Embodiment 38. The texture material dispensing system of embodiment 22, wherein the pivoting actuator is directly fluidically connected to the outlet opening.

Embodiment 39. The texture material dispensing system of embodiment 22, wherein the container stores a texture material and a propellant material.

Embodiment 40. A method of using a texture material dispensing system comprising:

a container assembly comprising a container and a valve assembly;

an actuator assembly comprising:

an actuator housing comprising a pivoting actuator;

a trigger pivotably attached to the pivoting actuator; and a handle pivotably attached to a portion of the actuator housing; and an outlet assembly comprising an outlet opening;

wherein depression of the trigger causes pivoting movement of the trigger relative to the pivoting actuator;

wherein the pivoting movement of the trigger relative to the pivoting actuator causes pivoting movement of the pivoting actuator relative to the actuator housing; and wherein the pivoting movement of the pivoting actuator engages the valve assembly to alter the valve assembly from a closed configuration to an open configuration, the method comprising using the texture material dispensing system for dispensing a texture material onto a target surface.

Embodiment 41. The method of embodiment 40, wherein the target surface is a ceiling.

Embodiment 42. The method of embodiment 40, wherein the method dispenses a popcorn texture onto the target surface.

Based upon the above discussion and illustrations, those skilled in the art will readily recognize that various modifications and changes may be made to the various embodiments without strictly following the exemplary embodiments and applications illustrated and described herein. For example, the trigger, adjustable orifice, and actuator may be utilized for a multitude of different types of dispensers and dispensing approaches, for a variety of materials. Further, the embodiments noted herein may be combined, and further embodiments may be separated. Other shapes, such as an oblong shape, and other forms of rotation such as a truncated arc, may be utilized as well, with locking approaches as noted herein. Such modifications do not depart from the scope of various aspects of the invention, including aspects set forth in the claims.

This written description uses examples to illustrate the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

As used herein, the terms "comprises," "comprising," "includes," "including," "has," "having," "contains", "containing," "characterized by" or any other variation thereof, are intended to cover a non-exclusive inclusion, subject to any limitation explicitly indicated. For example, a composition, mixture, process or method that comprises a list of elements is not necessarily limited to only those elements but may include other elements not expressly listed or inherent to such composition, mixture, process or method.

The transitional phrase "consisting of" excludes any element, step, or ingredient not specified. If in the claim, such would close the claim to the inclusion of materials other than those recited except for impurities ordinarily associated therewith. When the phrase "consisting of" appears in a clause of the body of a claim, rather than immediately following the preamble, it limits only the element set forth in that clause; other elements are not excluded from the claim as a whole.

The transitional phrase "consisting essentially of" is used to define a composition or method that includes materials, steps, features, components, or elements, in addition to those literally disclosed, provided that these additional materials, steps, features, components, or elements do not materially affect the basic and novel characteristic(s) of the claimed disclosure. The term "consisting essentially of" occupies a middle ground between "comprising" and "consisting of".

Where a disclosure or a portion thereof is defined with an open-ended term such as "comprising," it should be readily understood that (unless otherwise stated) the description should be interpreted to also describe such a disclosure using the terms "consisting essentially of" or "consisting of."

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, the indefinite articles "a" and "an" preceding an element or component of the disclosure are intended to be nonrestrictive regarding the number of instances (i.e. occurrences) of the element or component. Therefore "a" or "an" should be read to include one or at least one, and the singular word form of the element or component also includes the plural unless the number is obviously meant to be singular.

As used herein, the term "about" means plus or minus 10% of the value.

What is claimed is:

1. A texture material dispensing system comprising:

a container assembly comprising a container and a valve assembly;

an actuator assembly comprising:

an actuator housing comprising an actuator that is slidably supported relative to the actuator housing by at least one rail portion;

a trigger pivotably attached to the actuator; and a handle pivotably attached to a portion of the actuator housing; and an outlet assembly comprising an outlet opening;

wherein depression of the trigger causes pivoting movement of the trigger relative to the actuator;

wherein the pivoting movement of the trigger relative to the actuator causes linear movement of the actuator relative to the actuator housing; and wherein the linear movement of the actuator engages the valve assembly to alter the valve assembly from a closed configuration to an open configuration.

2. The texture material dispensing system of claim 1, wherein the texture material dispensing system is configured for dispensing an aerosol comprising a texture material.

3. The texture material dispensing system of claim 1, wherein the texture material dispensing system is configured for dispensing a texture material onto a target surface.

4. The texture material dispensing system of claim 1, wherein the texture material dispensing system is configured to dispense a texture material when a user holds the handle and depresses a trigger member.

5. The texture material dispensing system of claim 1, wherein the texture material dispensing system is configured to dispense a texture material when a user simultaneously holds the handle and depresses a trigger member with a single hand.

6. The texture material dispensing system of claim 1, wherein the trigger is foldable between a non-use position that is aligned parallel to a container assembly axis and a use position that is aligned non-parallel to the container assembly axis.

7. The texture material dispensing system of claim 1, wherein the handle is foldable between a non-use position that is aligned parallel to a container assembly axis and a use position that is aligned non-parallel to the container assembly axis.

8. The texture material dispensing system of claim 7, wherein the handle prevents accidental actuation of the trigger when it is folded in the non-use position that is aligned parallel to the container assembly axis.

9. The texture material dispensing system of claim 1, wherein the handle is hollow.

10. The texture material dispensing system of claim 1, wherein the handle comprises a spring portion along a left exterior edge of the handle and a spring portion along a right exterior edge of the handle.

11. The texture material dispensing system of claim 10, wherein the portion of the actuator housing is an exterior portion of the actuator housing.

12. The texture material dispensing system of claim 11, wherein the exterior portion of the actuator housing comprises a hinge portion comprising a left hinge portion and a right hinge portion; wherein the left hinge portion and the right hinge portion each individually comprise at least two slots that are each individually configured to engage with the spring portion along the left exterior edge of the handle and the spring portion along the right exterior edge of the handle.

13. The texture material dispensing system of claim 12, wherein the left hinge portion and the right hinge portion each individually comprise a non-use slot that is aligned parallel to a container assembly axis and a use slot that is aligned non-parallel to the container assembly axis.

14. The texture material dispensing system of claim 1, wherein the depression of the trigger causes a portion of the trigger within the actuator housing to press against an interior surface of the actuator housing, wherein force resulting from the portion of the trigger within the actuator housing pressing against the interior surface of the actuator housing causes the linear movement of the actuator relative to the actuator housing.

15. The texture material dispensing system of claim 1, wherein the actuator assembly comprises a tube that fluidically connects the actuator and the outlet opening.

16. The texture material dispensing system of claim 1, wherein the actuator is directly fluidically connected to the outlet opening.

17. The texture material dispensing system of claim 1, wherein the container stores a texture material and a propellant material.

18. A method of using a texture material dispensing system comprising:

a container assembly comprising a container and a valve assembly;

an actuator assembly comprising:

an actuator housing comprising an actuator that is slidably supported relative to the actuator housing by at least one rail portion;

a trigger pivotably attached to the actuator; and a handle pivotably attached to a portion of the actuator housing; and an outlet assembly comprising an outlet opening;

wherein depression of the trigger causes pivoting movement of the trigger relative to the actuator;

wherein the pivoting movement of the trigger relative to the actuator causes linear movement of the actuator relative to the actuator housing; and wherein the linear movement of the actuator engages the valve assembly to alter the valve assembly from a closed configuration to an open configuration, the method comprising using the texture material dispensing system for dispensing a texture material onto a target surface.

19. The method of claim 18, wherein the target surface is a ceiling.

20. The method of claim 18, wherein the method dispenses a popcorn texture onto the target surface.

* * * * *